United States Patent [19]

Petz

[11] Patent Number: 4,636,615

[45] Date of Patent: Jan. 13, 1987

[54] ELECTRICAL RESISTANCE HEATING ELEMENT HAVING A BIMETALLIC PROTECTIVE SWITCH

[75] Inventor: Gunter Petz, Nuremberg, Fed. Rep. of Germany

[73] Assignee: Petz Elektro GmbH, Hasslach, Fed. Rep. of Germany

[21] Appl. No.: 664,476

[22] Filed: Oct. 24, 1984

[30] Foreign Application Priority Data

Mar. 15, 1984 [DE] Fed. Rep. of Germany ..... 3409495

[51] Int. Cl.[4] ..... H05B 1/02; H05B 3/00; F24H 3/04

[52] U.S. Cl. ..... 219/363; 219/364; 219/375; 219/532; 337/379; 338/280; 338/293; 338/316

[58] Field of Search ..... 219/369–372, 219/375, 376, 379, 380–382, 532, 363, 364; 34/96–101; 132/9; 338/280–284, 316, 293; 337/379

[56] References Cited

U.S. PATENT DOCUMENTS 1,717,550 6/1929 Carmean ..... 219/370 X
3,988,708 10/1976 Thorsteinsson et al. ..... 337/379
4,341,946 7/1982 Ohnmacht et al. ..... 219/370

FOREIGN PATENT DOCUMENTS 510562 10/1930 Fed. Rep. of Germany ..... 219/363
3004874 8/1981 Fed. Rep. of Germany ..... 219/375
2028595 3/1980 United Kingdom ..... 219/375

*Primary Examiner*—Anthony Bartis
*Attorney, Agent, or Firm*—Collard, Roe & Galgano

[57] ABSTRACT

An electrical radiator, particularly for fan-forced heaters, is provided which includes a resistance heating element disposed on an insulating element connected to the housing of the fan-forced heater. The coil winding of the resistance heating element is secured to the insulating element by means of clamping elements and is freely extending therefrom. A bimetallic switch in series with the resistance heating element serves as a heat protective switch and is disposed on a connector bar connected to the insulating element and carrying the electrical connectors for the coil winding. One end of the coil winding is secured on one side of the bar to a first bracket remote from the insulating element and which is rigid with the bar and connected to a first connector. The other end of the coil winding is secured to a second bracket disposed on the other side of the bar near the insulating element and which is rigid with the bar. The bimetallic switch is disposed on a side of the connector bar which faces that end of the coil winding which is, on one hand, connected to the insulating element and, on the other hand, is secured to the first bracket remote from the insulating element, so as to obtain exactly defined protective circuits.

2 Claims, 3 Drawing Figures

ELECTRICAL RESISTANCE HEATING ELEMENT HAVING A BIMETALLIC PROTECTIVE SWITCH

The present invention relates to an electrical radiator, particularly for fan-forced heaters which includes a resistance heater disposed on an insulating element connected to the housing of the fan-forced heater. The resistance heater is comprised of winding loops or coils of electrical resistance wire secured to the insulating element by means of clamping elements with the coils or loops freely extending therefrom, and a bimetallic switch in series with the resistance heater and serving as a heat protective switch. The bimetallic switch is disposed on a connector bar which carries the electrical connectors and which is connected to the insulating element. One end of the coil winding remote from the insulating element is secured on one side of the connector bar to a bracket rigidly connected to the bar and also connected to a connector. The other end of the coil winding near the insulating element is secured on the other side of the connector bar to another bracket rigid with the bar and connected to another connector.

In electrical radiators or heaters of this type, it is common practice to locate the bimetallic switch on the side of the connector bar carrying the connector which is located near the insulating element. However, it has been shown that the coil winding adjacent to the bimetallic switch, because it freely extends from the insulating element, bends so as to be located close to or more remote from the bimetallic switch as a result of thermal or mechanical influences. This, in turn, leads to more or less greater spacings and to an indeterminate response of the bimetallic switch which, in turn, results in imprecise protective switching.

It is, therefore, an object of the present invention to provide for exactly defined protective switching arrangements for electrical radiators or heaters.

According to the present invention, this object is accomplished by positioning the bimetallic switch on the side of the connector bar facing the coil winding which is connected to that bracket which is remote from the insulating element. In this manner, the bimetallic switch is adjacent that coil winding which is fixed at both its ends, i.e., at the insulating element by means of the clamping device and at the bracket attached to the connector bar, so as to maintain a constant spacing from the bar. Thus, maintenance of a predetermined spacing is insured and an exactly defined protective switching is attainable. In the formation of the radiator, the bimetallic switch is arranged within a recess on the bar. The recess can optionally serve to accommodate a heating resistor connected in a known manner in parallel with the bimetallic switch.

Other objects and features of the present invention will become apparent from the following detailed description considered in connection with the accompanying drawing. It is to be understood, however, that the drawing is designed as an illustration only and not as a definition of the limits of the invention.

In the drawing wherein similar reference characters denote similar elements throughout the several views.

Figure 1:
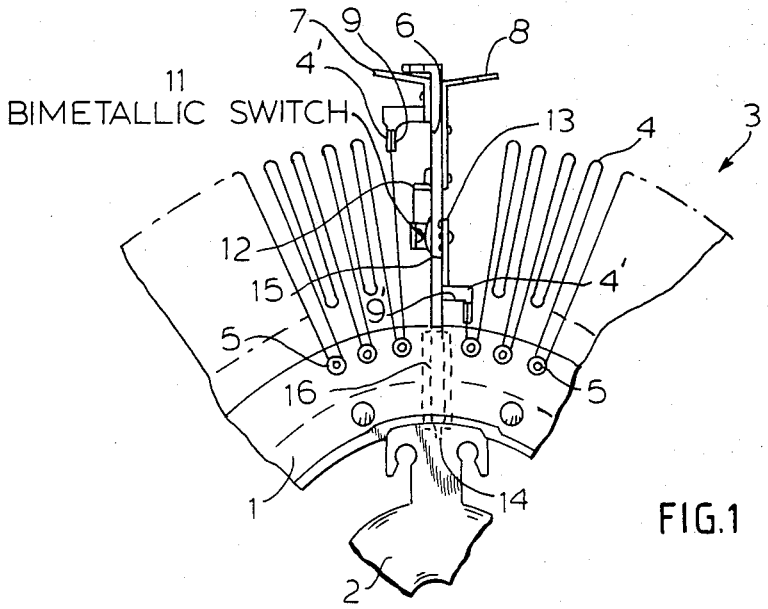
FIG. 1 is a fragmentary view of an electrical radiator embodying the present invention.
Figure 3:
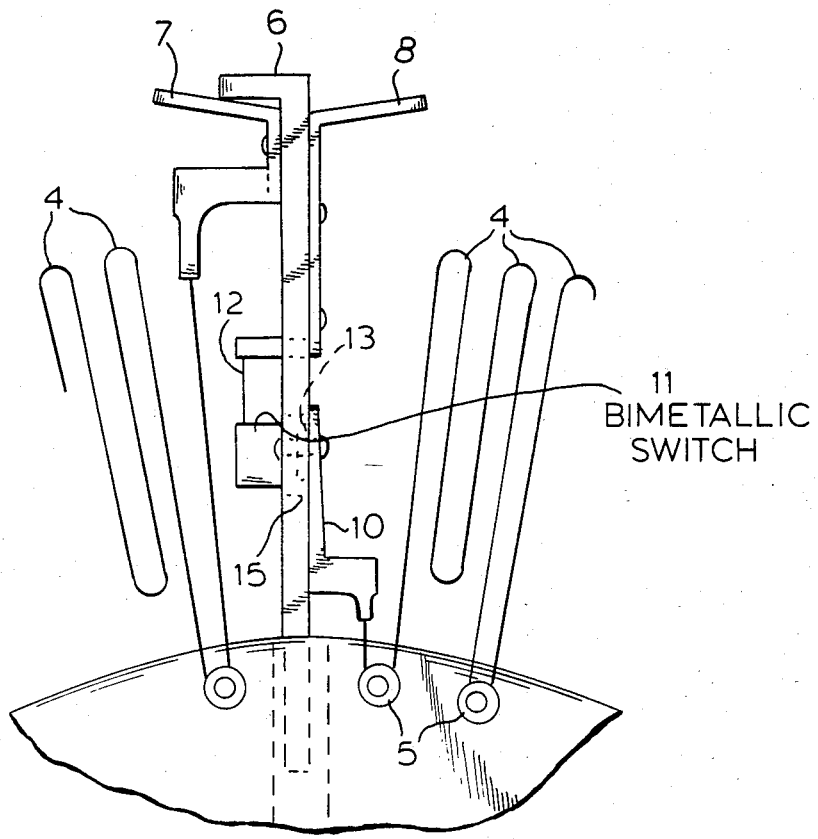
FIG. 3 is an enlarged fragmentary view of a portion of the electrical radiator shown in FIG. 1.

In FIG. 1, there is shown a ring-shaped insulating element designated with the reference numeral 1, which is secured by means of a hub 2 to a fan-forced heater housing, not further illustrated in detail. A resistance heating element 3 comprising a plurality of coil windings 4 is disposed on insulating element 1. Each of the coils of winding 4 is fastened at one end to insulating element 1 by means of hollow rivets 5 and is formed so that the coils freely extend from insulating element 1. A connector bar 6 is connected to insulating element 1 and carries electrical connectors 7 and 8 for the resistance heating element. A bracket 9 is rigidly connected to connector 7, to which, in turn, an end 4' of resistance heating element 3 is rigidly connected, as a result of which end 4' is securely held to connector bar 6 both within the region of insulating element 1 by a rivet 5 as well as by means of bracket 9. An end 4'' of resistance heating element 3 is secured to a further bracket 9' on bar 6 which is connected through an electrical conductor 10 with a bimetallic switch 11 which serves as a heat-protective switch. Bimetallic switch 11, as clearly seen in FIG. 3, extends through a recess 15 on a side of the bar 6 facing coil winding end 4'. Bimetallic switch 11 is connected to connector 8 through a conductor 12. An electric heating element 13 of low output is connected in parallel with the bimetallic switch 11 in a known manner. Connector bar 6 is inserted into a sleeve 16 so as to be rigidly connected to insulating element 1 and is fixed to sleeve 16 by means of holding pins 14 extending below sleeve 16.

FIG. 1 shows that in view of the end 4' of resistance heating element 3 being thus secured, a constant spacing of the resistance element 3 to the bimetallic switch is ensured and maintained, and an exactly defined operation of bimetallic switch 11 is ensured by such constant spacing.

Figure 2:
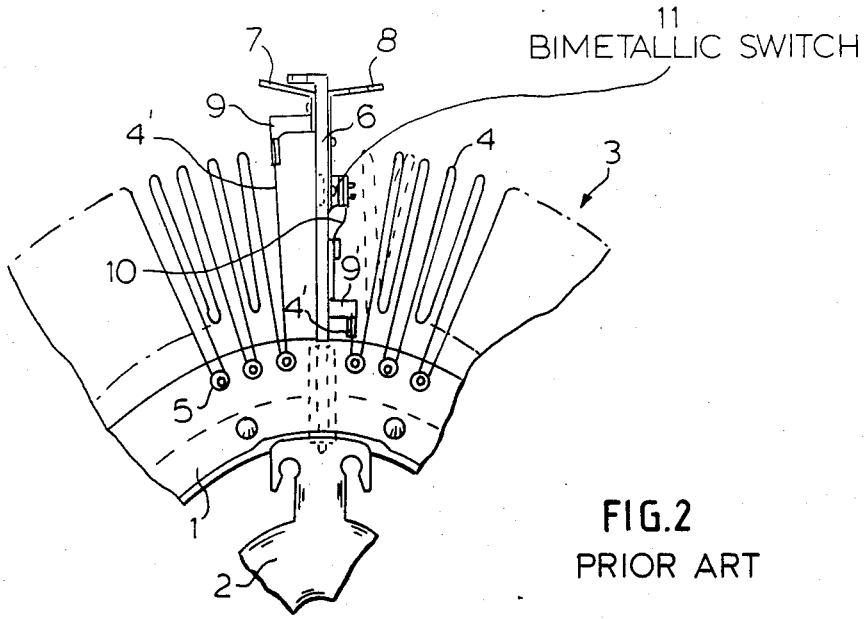
FIG.2 PRIOR ART
FIG. 2 is a fragmentary view of a prior art electrical radiator.

In FIG. 2, there is shown a prior art resistance heating element 3. In a construction which is otherwise the same as described above, the bimetallic switch 11 is disposed on the other side of connector bar 6 and consequently is adjacent a freely extending end or loop of coil winding 4. Thus, in the case of any thermal or mechanical influences on coil winding 4, the free end or loop of the coil adjacent the bimetallic switch takes up independently, and without being specifically set, a position arbitrarily more or less near the bimetallic switch, for example, at a distance (a) or at a more remote position at a distance (b). Thus, there results different spacings of the free end of the coil adjacent to the bimetallic switch which, in turn, results in an unintentionally early or later response of bimetallic switch 11. As a result, switching occurs at varying temperatures and reliable protection of the electrical resistance heater is not possible.

While only a single embodiment of the present invention has been shown and described, it will be obvious that many changes and modifications may be made thereunto without departing from the spirit and scope of the invention.

What is claimed is:

1. In an electrical radiator, particularly for fan-forced heaters, comprising a resistance heating element in the form of a coil winding disposed on an insulating element adapted to be connected to the housing of the fan-forced heater, the coil winding of the resistance heating element being secured to the insulating element by means of clamping elements and freely extending therefrom, and a bimetallic switch in series with the resistance heating element serving as a heat protective switch, the bimetallic switch being disposed on an electrically insulated connector bar connected to the insulating element and carrying two electrical connectors for the coil winding, wherein one end of the coil winding is secured on one side of the bar to a first metallic bracket rigid with the bar and connected to a first connector, said first bracket being remote from the insulating element, and the other end of the coil winding being secured to a second metallic bracket rigid with the bar and disposed on the other side of the bar near the insulating element, said bimetallic switch being electrically connected between said second bracket and said second connector, the improvement comprising the bimetallic switch being located on the side of the connector bar facing the end of the coil winding which is connected to the insulating element and secured to the first bracket remote from the insulating element.

2. The electrical radiator according to claim 1, wherein the bimetallic switch extends along a recess formed in the connector bar.

* * * * *